US008290414B2

(12) United States Patent
Takayanagi

(10) Patent No.: US 8,290,414 B2
(45) Date of Patent: Oct. 16, 2012

(54) IMAGE FORMING APPARATUS

(75) Inventor: Hiroki Takayanagi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 492 days.

(21) Appl. No.: 12/487,147

(22) Filed: Jun. 18, 2009

(65) Prior Publication Data

US 2009/0317145 A1 Dec. 24, 2009

(30) Foreign Application Priority Data

Jun. 18, 2008 (JP) ..... 2008-158698

(51) Int. Cl.
*G03G 15/16* (2006.01)

(52) U.S. Cl. ..... 399/316; 399/66; 399/397

(58) Field of Classification Search ..... 399/66, 399/302, 308, 316, 361, 397, 400
See application file for complete search history.

(56) References Cited

U.S. PATENT DOCUMENTS

| | | | | |
|---|---|---|---|---|
| 5,027,152 | A | 6/1991 | Oda et al. | 355/200 |
| 5,091,754 | A * | 2/1992 | Abe et al. | 399/394 |
| 6,581,928 | B1 * | 6/2003 | Stephan | 271/188 |
| 6,587,667 | B2 * | 7/2003 | Hauptmann | 399/400 |
| 7,216,863 | B2 * | 5/2007 | Kuwata et al. | 270/58.11 |
| 2002/0176726 | A1 * | 11/2002 | Ohuchi et al. | 399/400 |

FOREIGN PATENT DOCUMENTS

| | | |
|---|---|---|
| JP | 3-29963 | 2/1991 |
| JP | 4-100078 | 4/1992 |
| JP | 5-94100 | 4/1993 |
| JP | 6-222682 | 8/1994 |
| JP | 8-152772 | 6/1996 |

* cited by examiner

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

An image forming apparatus includes a pair of regulating members, for regulating movement of a recording material conveyed from a secondary transfer portion toward an intermediary transfer belt side, configured to be contactable to the recording material at both end portions with respect to a width direction perpendicular to a conveyance direction of the recording material; a moving mechanism capable of moving a position of the pair of regulating members with respect to the width direction; a recording material size detecting portion for obtaining width information of the recording material with respect to the width direction perpendicular to the conveyance direction; and a width control portion for controlling the moving mechanism so that the pair of regulating members to a position correspondingly to the width information obtained by the recording material size detecting portion.

7 Claims, 14 Drawing Sheets

(a)

(b)

IMAGE FORMING APPARATUS

FIELD OF THE INVENTION AND RELATED ART

The present invention relates to an image forming apparatus such as an electrophotographic copying machine or a laser printer and specifically relates to conveyance of a recording material after a toner image formed on an image bearing member such as a photosensitive drum or an intermediary transfer member is transferred onto the recording material.

An image forming apparatus such as a copying machine of an electrophotographic type or an LBP (laser beam printer) has been widely used. Such an image forming apparatus includes, e.g., an image forming apparatus 200 as shown in FIG. 11. FIG. 11 is a schematic view showing a constitution of the conventional image forming apparatus 200. Specifically, FIG. 11 principally illustrates an image forming station, of the image forming apparatus 200, for forming an image on a recording material which has been conveyed.

The image forming apparatus 200 includes an electrophotographic photosensitive member (photosensitive drum) 201, as an image bearing member generally, of a rotatable drum type in a direction indicated by an arrow and further includes a charger 202 and an exposure device 203. Further, the image forming apparatus 200 includes, around the photosensitive drum 201, a rotary developing device 208 including developing devices 204Y, 204M, 204C and 204K for yellow (Y), magenta (M), cyan (C) and black (K), respectively.

To the photosensitive drum 201, a belt-like intermediary transfer member (intermediary transfer belt) 209 is disposed oppositely. This intermediary transfer belt 209 is supported by a driving roller 214, a secondary transfer inner roller 213, a tension roller 212, a primary transfer roller 215, and stretching rollers 210 and 211 and is rotated in a direction indicated by arrows in the figure. The stretching rollers 210 and 211 are rotated by the intermediary transfer belt 209 to form a flat primary transfer surface. Onto the intermediary transfer belt 209, unfixed toner images for respective color components formed on the photosensitive drum 201 are successively primary-transferred electrostatically every rotation of the photosensitive drum 201. In the image forming apparatus 200, the above-superposed four-color based full-color images are secondary-transferred collectively at a secondary transfer portion T from the intermediary transfer belt 209 onto a recording material 220 conveyed in a direction indicated by an arrow by a conveying roller pair 219. The image forming apparatus 200 includes cleaning devices 217 and 223 for removing residual toner.

In the above-described image forming apparatus 200, to a secondary transfer outer roller 221, a secondary transfer voltage is applied by a secondary transfer electric field generating means 227 from a pre-stage of reaching of the recording material 220 to the secondary transfer portion T so as to uniformize electric charges over the entire surface of the recording material 220.

Here, in the case where the intermediary transfer belt 209 has a volume resistivity of $1.0\times10^9$ ohm.cm, a charge decay time can be about 0.1 sec. For this reason, e.g., when the intermediary transfer belt 209 has a peripheral speed of 130 mm/sec, a leading end portion in a length of about 13 mm of the recording material 220 is electrostatically attracted toward the intermediary transfer belt 209 after passing through the secondary transfer portion T and clings to the intermediary transfer belt 209 in some cases. That is, when the secondary transfer electric field generating means 227 is actuated before the recording material 220 reaches the secondary transfer portion T, there is a possibility that the electric charges at the leading end portion of the recording material 220 cannot be completely attenuated even after passing through the secondary transfer portion T due to the volume resistivity and the peripheral speed of the intermediary transfer belt 209. Therefore, the leading end portion of the recording material 220 clings to the intermediary transfer belt 209, so that a problem of an occurrence of separation defect of the recording material 220 arises.

In order to solve such a problem, the following method has been proposed.

That is, to the secondary transfer outer roller 221 provided at the secondary transfer portion T, a constant voltage from the secondary transfer electric field generating means 227 is applied in a controlled matter. Then, control is made so that a current smaller than a predetermined secondary transfer current value is caused to pass through the secondary transfer portion T until a lapse of a predetermined time from the reaching of the leading edge of the recording material 220 to the secondary transfer portion T. That is, by reducing an amount of secondary transfer electric charges stored in advance at the leading end portion of the recording material 220, the charge decay time at the leading end portion of the recording material 220 is shortened, so that a clinging force of the leading end portion of the recording material 220 to the intermediary transfer belt 209 is decreased (Japanese Laid-Open Patent Application (JP-A) Hei 05-094100).

However, as shown in FIG. 12(*a*), the leading end portion of the recording material 220 is separated once from the intermediary transfer belt 209 as the image bearing member irrespective of a magnitude of the secondary transfer current at that time. This is because in a state in which the recording material 220 is bent and deformed ($\Delta x$ in FIG. 12(*a*)), the moment of a couple at each point on the recording material 220 and the moment of force acting on the recording material 220 at each point by an electrostatic force F directed toward the intermediary transfer belt 209 are balanced with each other. That is, stiffness (rigidity) of the recording material 220 is above an electrostatic force required for bringing the recording material 220 into contact with the intermediary transfer belt 209 immediately after the recording material 220 passes through the secondary transfer portion T.

Thereafter, when the length of the conveyed recording material 220 from the secondary transfer portion T is increased, as shown in FIG. 12(*b*), the flexure deformation amount $\Delta x$ of the recording material 220 is increased compared with that in the state shown in FIG. 12(*a*). When the length of the conveyed recording material 220 from the secondary transfer portion T is further increased, as shown in FIG. 12(*c*), the recording material 220 is attracted toward the intermediary transfer belt 209 to contact the intermediary transfer belt 209, thus causing the separation defect.

Therefore, in the image forming apparatus 200 of JP-A Hei 05-094100, a separation claw 222 as shown in FIG. 11 is disposed in the neighborhood of the intermediary transfer belt 209 and abuts against the surface (image carrying surface) of the recording material 220 attracted toward the intermediary transfer belt 209 to prevent contact between the recording material 220 and the intermediary transfer belt 209. In the image forming apparatus, the recording material 220 conveyed from the secondary transfer portion T is initially placed in a state in which its leading end portion is separated from the intermediary transfer belt 209 (FIG. 13(*a*)). Thereafter, when the length of a portion of the recording material 220 which has passed through the secondary transfer portion T is further increased, the leading end portion of the recording material 220 is liable to be attracted toward the intermediary transfer belt 209 but an attracting operation is suppressed by the above-described separation claw 222 (FIG. 13(*b*)). Thus, as shown in FIG. 13(*c*), the recording material 220 is rectified so that its conveyance direction is in a normal state and is then conveyed and discharged.

However, in the conventional image forming apparatus provided with the separation claw 222 as described above, the separation claw 222 contacted the image carrying surface of the recording material 220, so that there was a possibility that the separation claw 222 disturbs the image (unfixed toner image) after the secondary transfer and also breaks the recording material 220. As another conventional image forming apparatus, an image forming apparatus in which the separation claw 222 is provided with a rotatable wheel 225, having regularly spaced projections, as its lower contact portion to reduce a contact area between the separation claw 222 and the image carrying surface of the recording material 220 has been considered.

The separation claw 222 shown in FIG. 14 was capable of reducing the contact area between it and the recording material attracted toward the image bearing member by being provided with the rotatable wheel 225. However, only the wheel 225 contacts the recording material, so that the unfixed toner image was disturbed at the contact portion of the wheel 225 although the disturbance of the unfixed toner image on the recording material 220 was relatively suppressed. Further, in the case where the separation claw 222 as shown in FIG. 14 was used for a long term, contaminant (toner) was deposited or accumulated on the wheel 225 itself, thus resulting in an occurrence of a problem that the contaminant was able to contaminate or break the recording material 220 contacting the wheel 225.

SUMMARY OF THE INVENTION

A principal object of the present invention is to enhance a separation property of a recording material from an intermediary transfer member while reducing a degree of contact with an image on the recording material.

An object of the present invention is to provide an image forming apparatus capable of enhancing the separation property.

According to an aspect of the present invention, there is provided an image forming apparatus comprising:

an image bearing member;

a toner image forming portion for forming a toner image on the image bearing member;

a transfer member for forming a transfer portion for transferring the toner image from the image bearing member onto a recording material; and a regulating member for regulating movement of the recording material, being passing through the transfer portion, in a width direction perpendicular to a conveyance direction of the recording material on a downstream side of the transfer portion with respect to the conveyance direction, wherein the regulating member includes a pair of regulating portions contactable to respective lateral ends of the recording material, being passing through the transfer portion, and wherein the regulating portions are provided at positions in which the regulating portions define a spacing therebetween narrower than a width of the recording material, being passing through the transfer portion, with respect to the width direction.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, several embodiments of the present invention will be described with reference to the drawings. The image forming apparatus according to the present invention can also be carried out in other embodiments in which a part or all of constitutions in the embodiments of the present invention are replaced with their alternative constitutions so long as movement regulation control of a recording material to be conveyed from a transfer portion toward an image bearing (carrying) member is effected.

Therefore, the present invention can also be carried out in a tandem type image forming apparatus in which a plurality of image bearing members is arranged along a recording material conveying member or an intermediary transfer or a monochromatic image forming apparatus in which a toner image is directly transferred onto the recording material, or the like.

In this embodiment, only a principal portion concerning formation and transfer of the toner image will be described but the present invention can be carried out in various fields of apparatuses, such as a printer, various printing machines, a copying machine, a facsimile machine, and a multi-function machine, by adding necessary device, equipment, and housing structure.

(Image Forming Apparatus)

Figure 1:
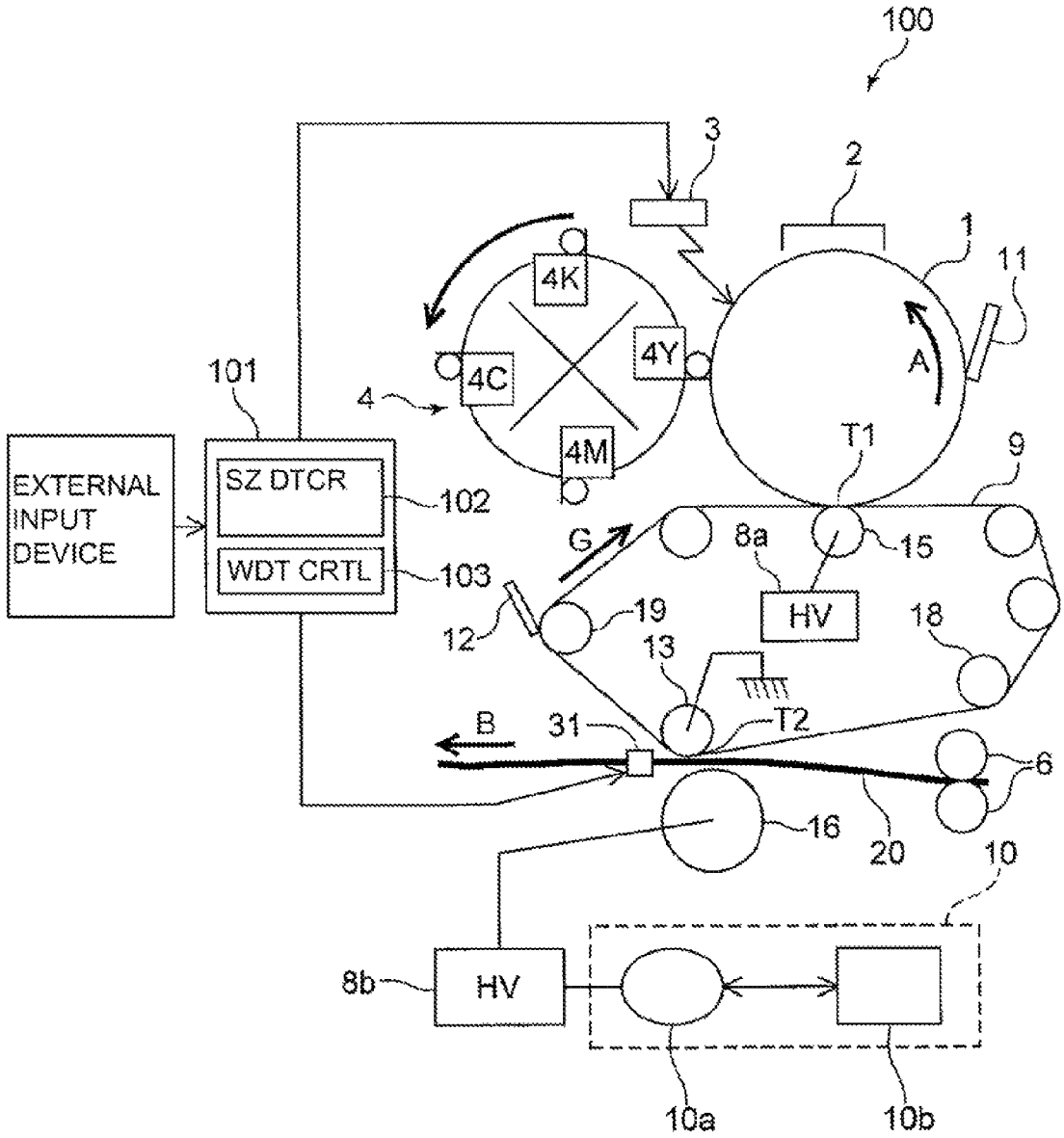
FIG. 1 is a schematic view for illustrating a constitution of an image forming apparatus in an embodiment of the present invention.

FIG. 1 is a schematic view for illustrating a constitution of an image forming apparatus 100 in this embodiment. The image forming apparatus 100 in this embodiment is a full-color laser beam printer in which a toner image forming means for forming the toner image on the image bearing member and an intermediary transfer belt (image bearing member) 9 in the form of an endless belt are oppositely disposed.

As shown in FIG. 1, the image forming apparatus 100 forms respective color toner images of yellow, magenta, cyan and black in turn on a photosensitive drum 1 and primary-transfers the toner images onto an intermediary transfer belt 9 every one rotation of the intermediary transfer belt 9. During four rotations of the intermediary transfer belt 9, the four color toner images primary-transferred onto the intermediary transfer belt 9 at a primary transfer portion T1 in a superposition manner as collectively secondary-transferred onto a recording material 20 at a secondary transfer portion (toner portion) T2. The recording material 20 on which the four color toner images have been secondary-transferred is conveyed to an unshown fixing device by an unshown conveying member, in which the recording material 20 is subjected to heat pressing to have fixed (melt-fixed) toner images at its surface. In this embodiment, the toner image forming means forms the toner images on the intermediary transfer belt 9.

The photosensitive drum 1 as an example of the image bearing member is constituted in a rotatable drum shape by a metal cylinder having an electrophotographic layer at its surface.

A charging device 2 as an example of a charging means electrically charges the surface of the photosensitive drum 1 by using a corona discharger. The charging device 2 irradiates the surface of the photosensitive drum 1 with corona discharge ions to electrically charge the surface of the photosensitive drum 1 uniformly.

An exposure device 3 as an example of an exposure means effects laser beam scanning to write an electrostatic image correspondingly to image information on the surface of the charged photosensitive drum 1 by a known electrophotographic process. This image information is sent from external input equipment (device) such as a personal computer to the exposure device 3 through a control portion 101.

The control portion 101 effects movement control of a moving mechanism 32 described later by a width control means 103 on the basis of a result (i.e., width information of the recording material 20 with respect to a direction perpendicular to a conveyance direction of the recording material 20) obtained by a recording material size detecting means 102 as an example of a width information obtaining means. The width control means 103 moves a position of a regulating member described later by the moving mechanism 32. In this embodiment, the recording material size detecting means 102 obtains the width information of the recording material from image forming information instructed from the external input equipment such as the personal computer. However, in addition, the width information of the recording material may also be obtained by, e.g., disposing a sensor or the like upstream of the secondary transfer portion T2 with respect to the conveyance direction of the recording material so as to detect the width information from the conveyed recording material, so that an obtaining method of the width information is not limited particularly. That is, the control portion 101 has the function as an input portion into which the information detected by the recording material size detecting means 102 or the information from the external input equipment is inputted.

A developing device 4 as an example of a developing means rotates to position a yellow developing device 4Y, a magenta developing device 4M, a cyan developing device 4C, and a black developing device 4K at a developing position for the photosensitive drum 1. The developing devices 4Y, 4M, 4C and 4K as the example of the developing means use a two component developer including a magnetic carrier and associated color toner in mixture.

The yellow developing device 4Y, when it is moved to the developing device position for the photosensitive drum 1, develops the electrostatic image into a yellow toner image by depositing electrically charged yellow toner on the electrostatic image on the photosensitive drum 1 (reversal development). The magenta developing device 4M, when it is moved to the developing position for the photosensitive drum 1, develops the electrostatic image into a magenta toner image by depositing electrically charged magenta toner on the electrostatic image on the photosensitive drum 1 (reversal development). The cyan developing device 4C, when it is moved to the developing device position for the photosensitive drum 1, develops the electrostatic image into a cyan toner image by depositing electrically charged cyan toner on the electrostatic image on the photosensitive drum 1 (reversal development) The black developing device 4K, when it is moved to the developing position for the photosensitive drum 1, develops the electrostatic image into a black toner image by depositing electrically charged black toner on the electrostatic image on the photosensitive drum 1 (reversal development) Thus, by the developing device 4, the electrostatic image on the photosensitive drum 1 (the image bearing member) is developed, so that the toner image is formed on the photosensitive drum 1.

A cleaning device 11 removes transfer residual toner which has passed through the primary transfer portion T1 and remains on the surface of the photosensitive drum 1.

The intermediary transfer belt 9 is supported by a driving roller 19, a secondary transfer inner roller 13, a tension roller 18, a primary transfer roller 15, and other stretching rollers to circulate in a direction indicated by arrow G. By the two rollers of the stretching rollers, a flat primary transfer surface is formed by being rotated by the intermediary transfer belt 9. The driving roller 19 drives and circulates the intermediary transfer belt 9 by being connected to a main assembly driving mechanism for rotationally driving the driving roller 19 and the photosensitive drum 1 in common. The tension roller 18 controls a tension of the intermediary transfer belt 9 at a constant level by being urged by an unshown spring.

The intermediary transfer belt 9 is formed in an endless form by a resin material such as polyimide, polycarbonate, polyester, polypropyrene, polyethylene terephthalate, acrylic resin, vinyl chloride resin, or the like or by various rubber materials or the like. In these base materials, carbon black as an antistatic agent is contained in an appropriate amount to adjust a volume resistivity at $1\times10^{8}$ to $1\times10^{13}$ ohm.cm. The thickness of the intermediary transfer belt 9 is 70-100 μm.

The primary transfer roller 15 as an example of a transfer member presses the intermediary transfer belt 9 against the photosensitive drum 1 to form the primary transfer portion T1, as an example of the transfer portion, between the photosensitive drum 1 and the intermediary transfer belt 9. The primary transfer roller 15 rotates so that its surface moves in the same direction as that of the photosensitive drum 1. A power source 8*a* connected to the primary transfer roller 15 is a constant current power source and supplies a primary transfer current of 20-40 μA to the primary transfer roller 15. The power source 8*a* applies a primary transfer bias of a positive polarity opposite to the charge polarity of the toner images formed on the photosensitive drum 1 to the primary transfer roller 15, so that the toner images on the photosensitive drum 1 are primary-transferred onto the intermediary transfer belt 9.

A secondary transfer outer roller (transfer means) 16 can press the intermediary transfer belt 9 against the secondary transfer inner position 13, which is grounded as an opposite electrode to the secondary transfer outer roller 16, to form the secondary transfer portion T2 as the example of the transfer portion between the intermediary transfer belt 9 and the secondary transfer outer roller 16. A power source 8*b* as an example of a power source applies a DC voltage (opposite bias) of a polarity opposite to the charge polarity of the toner images carried on the intermediary transfer belt 9, so that the toner images are secondary-transferred onto the recording material 20 to be conveyed.

An output detecting member 10 for the power source 8*b* detects a current, when the recording material 20 is not conveyed, by a current detecting member 10*a*. The output detecting member 10 carries out this current detection 8 times during one rotation of the secondary transfer outer roller 16 and averages a result of the 8 times of the current detection by a computing device 10*b*, thus calculating an impedance of the secondary transfer portion T2. The transfer bias (output) from the power source 8 is controlled at a constant voltage so that a current of 40-70 μA flows during passing of plain paper through the secondary transfer portion T2 in the case of no toner image in a low humidity environment of 23° C. and 50% RH.

The above-described secondary transfer outer roller 16 is prepared by forming an electroconductive layer on an outer peripheral surface of a metal-made core (not shown) having an outer diameter of 12 mm and is constituted in an outer diameter of 24 mm. Further, the above-described primary transfer roller 15 is prepared by forming the electroconductive layer on an outer peripheral surface of the metal-mode core (not shown) having an outer diameter of 8 mm and is constituted in an outer diameter of 16 mm. The electroconductive layer uses a polymeric elastomer or polymeric foam material of a rubber, urethane, or the like as a base material and adds an ion conductive substance in the base material, so that a degree of electroconductivity thereof is adjusted in a medium resistance range from 1 MΩ to 100 MΩ. As the ion conductive substance added in the base material, sodium perchlorate is frequently used in general.

A cleaning device 12 removes transfer residual toner which has passed through the secondary transfer portion T2 and remains on the intermediary transfer belt 9.

The secondary transfer outer roller 16 and the cleaning device 12 are provided movably toward and away from the intermediary transfer belt 9. The secondary transfer outer roller 16 and the cleaning device 12 are separated from the intermediary transfer belt 9, so as to avoid contact with the toner images during the color image formation, until the toner image for the color prior to the final color is completely primary-transferred onto the intermediary transfer belt 9.

A registration roller pair 6 places the recording material 20, which has been fed from an unshown recording material accommodating cassette one by one in a stand-by state and sends the recording material 20 to the secondary transfer portion T2 with timing such that a leading end of the recording material 20 coincides with the toner images on the intermediary transfer belt 9.

Downstream of the secondary transfer portion T2 with respect to the conveyance direction of the recording material 20, a pair of regulating member 31, which are constituted so as to be contactable to respective lateral sides of the recording material 20 with respect to a width direction thereof perpendicular to the conveyance direction of the recording material 20, for regulating movement of the recording material 20 toward the photosensitive drum 1 is disposed.

(Embodiment 1)

Figure 2:
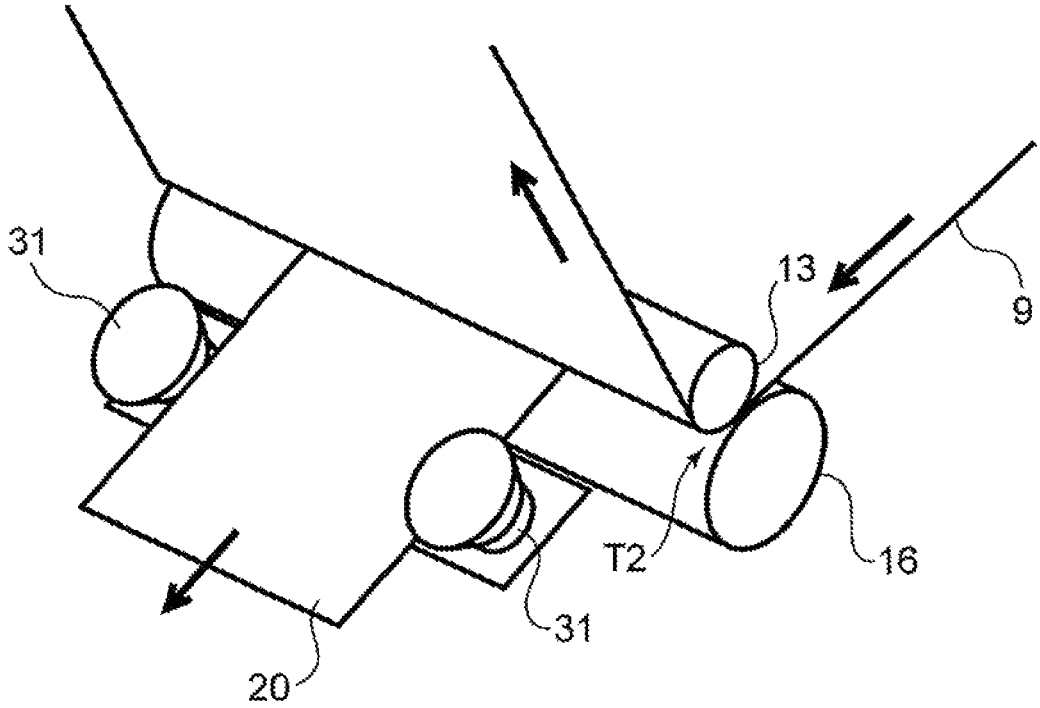
FIG. 2 is an enlarged schematic perspective view showing a regulating member, a secondary transfer portion and the neighborhood thereof in Embodiment 1.
Figure 3:
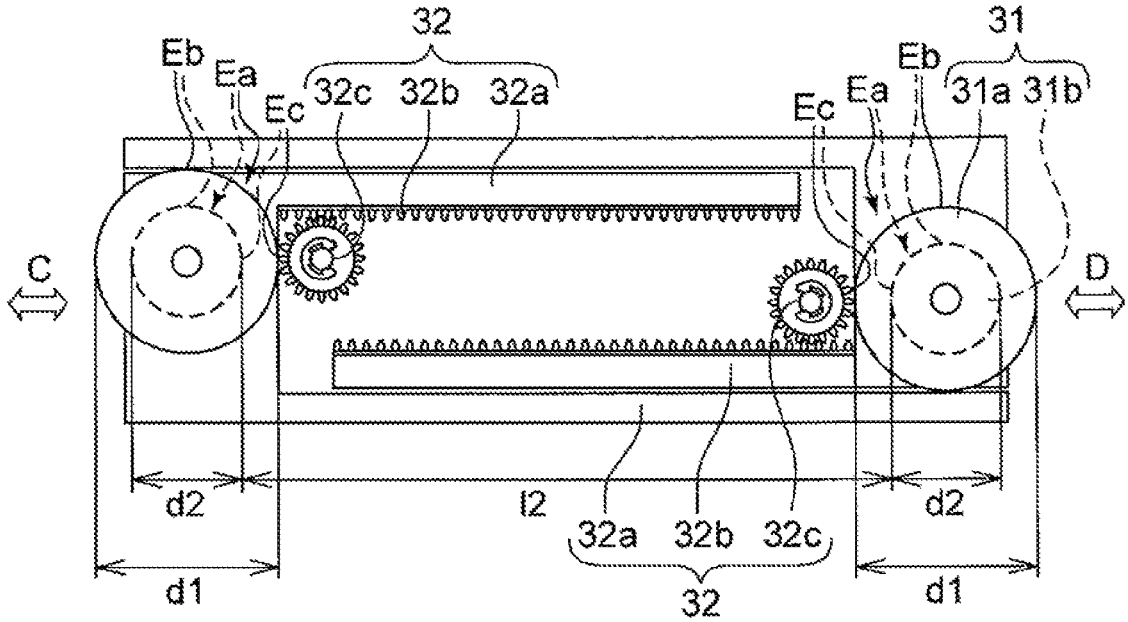
FIG. 3 is a plan view showing a moving mechanism for moving the regulating member.
Figure 4:
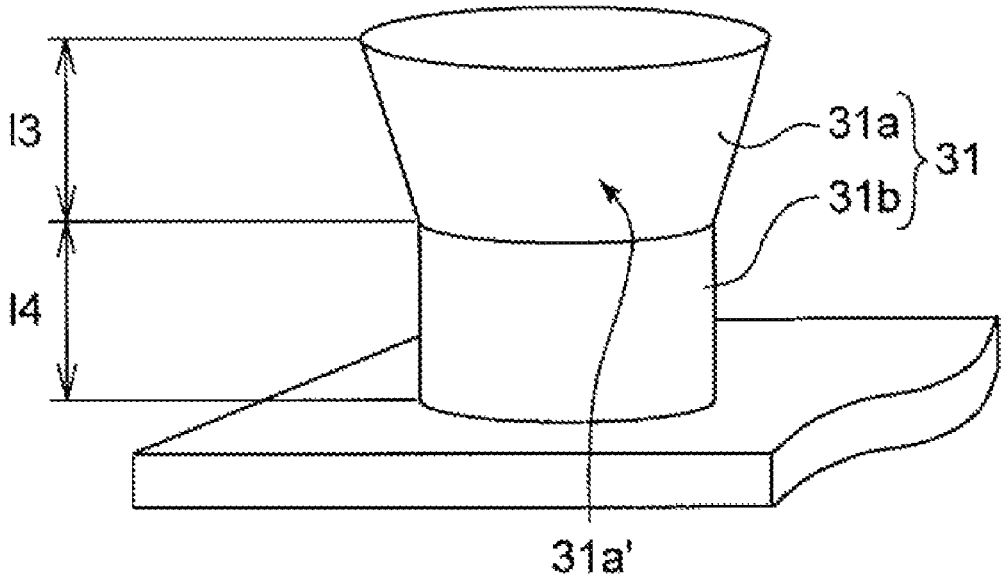
FIG. 4 is a perspective view showing the regulating member alone.
Figure 5:
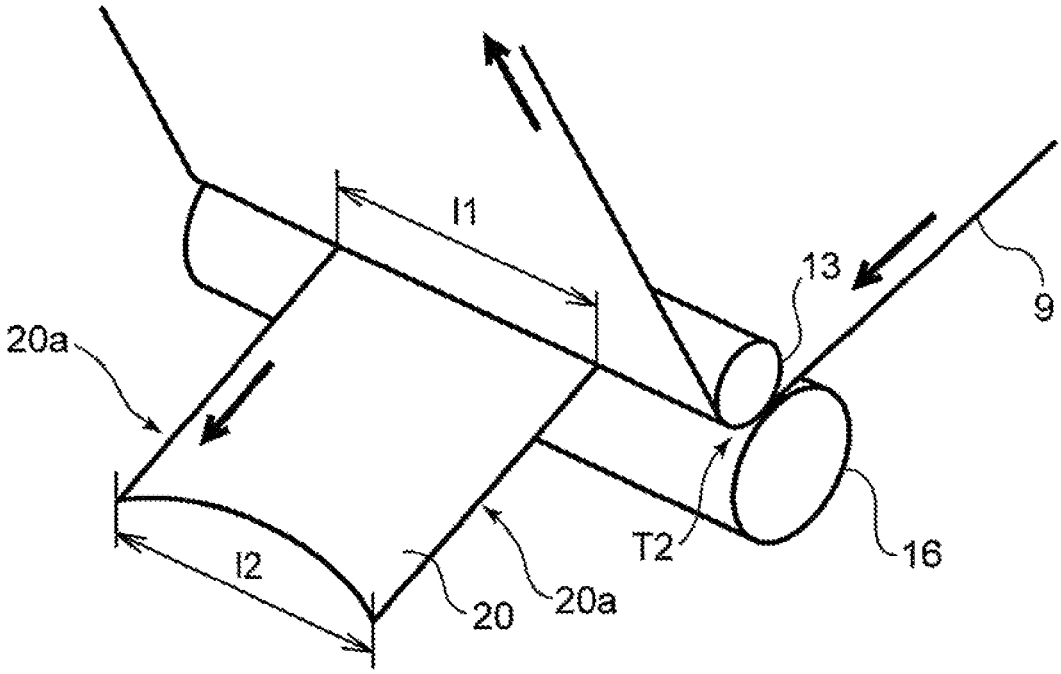
FIG. 5 is a schematic view showing an example of a recording material regulated by the regulating member.
Figure 6:
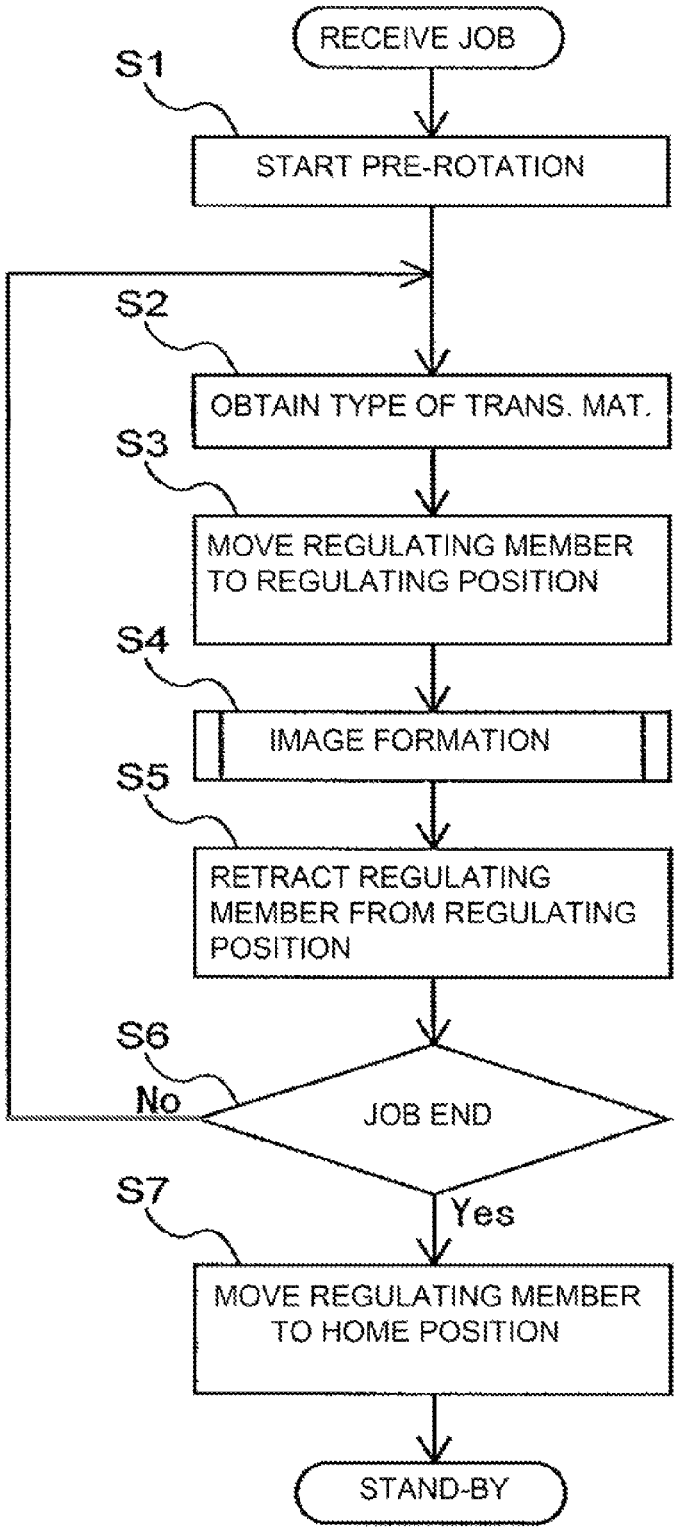
FIG. 6 is a flow chart for movement control of the regulating member.

A function in Embodiment 1, for improving a separation property of the recording material, employing the regulating member 31 as a feature of the present invention will be described with reference to FIG. 2 to FIG. 6. Incidentally, FIG. 2 is an enlarged schematic perspective view showing the regulating member 31, the secondary transfer portion T2 and the neighborhood thereof in Embodiment 1, FIG. 3 is a plan view showing the moving mechanism 32 for moving the regulating member 31, FIG. 4 is a perspective view showing the regulating member 31 alone, FIG. 5 is a schematic view showing an example of the recording material 20 regulated by the regulating member 31, and FIG. 6 is a flow chart for movement control of the regulating member 31. Further, in FIG. 5, in order to emphatically show a conveyance attitude of the recording material 20, the regulating member 31 is omitted from illustration for convenience. In this embodiment, a regulating means is constituted by the regulating member 31 and the moving mechanism 32.

The regulating member 31 is, as shown in FIG. 2, disposed downstream of the secondary transfer portion T2 with respect to the conveyance direction of the recording material 20 (e.g., at a distance of 10-20 mm from the secondary transfer portion T2). The regulating member 31 is constituted as a pair of regulating portions each regulating one of respective lateral sides of the recording material 20 with respect to the width direction perpendicular to the conveyance direction in a state in which the recording material 20 is conveyed from the secondary transfer portion T2.

The regulating member 31 is, as shown in FIG. 4, constituted by a circular truncated cone-like regulating portion (rotatable member) 31*a* and a columnar regulating portion (base portion) 31*b*. These portions 31*a* and 31*b* are co-axially disposed as shown in FIG. 3 and both are rotatable members. The regulating portions 31*a* of the pair of regulating members (regulating portions) 31 have inclined side surface portions 31*a*' so that a distance between the side surface portions 31*a*' is gradually decreased from the regulating portion 31*b* side toward the intermediary transfer belt 9 side and are tapered so as to be continuous with side surfaces of the regulating portions 31*b*. The regulating members 31 are rotated by the conveyance of the recording material when the recording material conveyed from the secondary transfer portion T2 contacts the side surface portions 31*a*', so that sliding friction of the regulating members 31 with the respective lateral sides of the recording material 20 conveyed from the secondary transfer portion T2 is reduced. The pair of regulating members 31 has entrance portions Ea for permitting easy introduction of the recording material conveyed from the secondary transfer portion T2. These entrance portions Ea are constituted by opposite surface portions directed toward an upstream side of the pair of regulating members 31 with respect to the conveyance direction (i.e., the secondary transfer portion T2 side) so as to provide an entrance of the recording material conveyed from the conveyance direction upstream side. The entrance portions Ea of the pair of regulating members 31 are constituted so that a distance between the entrance portions Ea is gradually narrowed from wide width portions Eb toward narrow width portions Ec with respect to the conveyance direction, along circumferences of circles as cross-sections of the regulating portions 31*a* and 31*b*. As a result, the recording material 20 conveyed from the secondary transfer portion T2 (e.g., conveyed in the direction (conveyance direction) indicated by an arrow B shown in FIG. 1) can be smoothly guided between the pair of regulating members 31.

Further, the regulating members 31 are, as shown in FIG. 3, disposed on moving members 32*a* each of which has a U-shape in a plane and is provided with a toothed rack portion 32*b*. A pinion 32*c* engaged with the rack portion 32*b* receives a rotational force from an unshown motor, so that the moving member 32*a* and the regulating member 31 disposed on the moving member 32*a* reciprocate in a left-right direction in FIG. 3 (the direction indicated by a double-pointed arrow C or D). As a result, the pair of regulating members 31 is movable in the width direction perpendicular to the conveyance direction of the recording material 20, so that the distance therebetween (i.e., a width l2) is variable. The above-described moving members 32*a*, rack portions 32*b*, and pinions 32*c* constitute the moving mechanisms 32 for moving the regulating members 31.

In Embodiment 1, a diameter d1 for an upper circular surface of each regulating portion 31*a* is 10 mm and a diameter d2 for a lower circular surface of each regulating portion 31*a* and for upper and lower circular surfaces of each regulating portion 31*b* is 6 mm. Further, each regulating portion 31*a* has a height l3 of 5 mm and each regulating portion 31*b* has a height l4 of 5 mm.

Then, a flow of a job regarding the image formation will be described with reference to FIG. 6. FIG. 6 is a flow chart showing the flow of the job regarding the image formation.

As shown in FIG. 6, in the image forming apparatus 100 in this embodiment, when the control portion 101 receives an image forming job regarding the image formation from the external input equipment such as the personal computer, pre-rotation of the photosensitive drum 1 and the intermediary transfer belt 9 is started (step S1).

Then, the control portion 101 obtains information on the type of an objective recording material 20 by a recording material size detecting means 102 (FIG. 1) on the basis of image formation information inputted from, e.g., an operating portion (step S2). The information on the type of the above recording material 20 is information on a width of the recording material 20 with respect to the direction perpendicular to the conveyance direction of the recording material 20 (hereinafter referred to as "width information"). Further, in this embodiment, the information on the type of the recording material 20 will be described as only the width information of the recording material 20 but in the case where another information is required for movement control of the regulating members 31, e.g., information on hardness (thickness) of the recording material 20 may also be obtained and added as a control element with respect to the regulating members 31. By adding the property such as the hardness (thickness) of the recording material 20, a movable position of the regulating members 31 can be determined with further flexibility.

Then, when the width information of the recording material 20 is detected, the pinions 32*c* of the above-described moving mechanisms 32 are rotationally controlled by a width control means 103. As a result, the pair of regulating members 31 is moved to a position correspondingly to the above-detected width information of the recording material 20 (i.e., the position in which the distance between the regulating members 31 is the width 12) (step S3). Accordingly, the pair of regulating members 31 is controlled to be moved to the position in which an end portion distance of the regulating portions 31*a* at the side surface portions 31*a*' on the intermediary transfer belt 9 side is narrower than the width of the width information of the recording material 20 and in which the distance between the wide width portions Eb is wider than the width of the width information and the distance between the narrow width portions Ec is narrower than the width of the width information.

Then, at an image forming station of the image forming apparatus 100, when the image formation on the recording material 20 is effected on the basis of the image forming information, the recording material 20 conveyed from the secondary transfer portion T2 is conveyed while be regulated by the pair of regulating members 31 which have been subjected to the movement control (step S4).

As described above, the pair of regulating members 31 which has been subjected to the movement control includes the regulating portions 31*a* having the side surface portions 31*a*' at which end portions thereof on the intermediary transfer belt 9 side are located between the respective lateral sides of the recording material 20 in the conveyance state and the intermediary transfer belt 9 to separate the portions of the recording material 20 from the intermediary transfer belt 9. As a result, even if the recording material 20 in the conveyance state is attracted toward the intermediary transfer belt 9 by the electrostatic force, the recording material 20 is regulated in movement by the time when the recording material 20 reaches the position of the intermediary transfer belt 9-side end portions of the side surface portions 31*a*' of the regulating portions 31*a*.

Therefore, the recording material 20 can be prevented from being attracted toward the intermediary transfer belt 9 to contact and be adsorbed by the intermediary transfer belt 9.

Then, when the recording material 20 having been subjected to the image formation passes through the secondary transfer portion T2 and the pair of regulating members 31 located downstream thereof, the pinions 32*c* are rotationally controlled by the width control means 103, so that the pair of regulating members 31 is retracted to a predetermined position in which the distance therebetween is larger than the width of the recording material 20 (step S5).

Then, whether or not the image forming job is completed is judged (step S6). In the case where the job is not completed, the procedure is returned to the step S2 in which the job is executed repeatedly (No of step S6). In the case where the image forming job is judged to be completed (Yes of step S6), the pinons 32*c* and rotationally controlled by the width control means 103 to move the pair of regulating members 31 to a home position (e.g., a maximum separation portion) (step S7), thus completing the job (stand-by).

In this embodiment, e.g., with respect to the recording material 20 having a width of 143 mm (length (width information) l1) and a conveyance direction length of 200 mm, the width l2 (the distance) between the regulating portions 31*b* of the pair of regulating members 31 was 140-142 mm less than the recording material width by 1-3 mm. When the pair of regulating members 31 is moved to the position with the width l2 and then the recording material 20 is moved between the pair of regulating members 31 while being subjected to the transfer at the secondary transfer portion T2, the recording material 20 is bent and deformed in the shape of an arc with respect to the intermediary transfer belt 9 to improve its stiffness (rigidity) (FIG. 5). As a result, the recording material 20 can be further reduced in amount of flexure deformation to ward the intermediary transfer belt 9 by the electrostatic force, so that it is possible to prevent the recording material 20 from contact and being adsorbed by the intermediary transfer belt 9 and to prevent the occurrence of separation defect.

Thus, the pair of regulating members 31 having been subjected to the movement control is contactable to only the respective lateral sides 20*a* (FIG. 5) of the recording material 20 with respect to the width direction perpendicular to the conveyance direction of the recording material 20. Such respective lateral sides 20*a* of the recording material 20 are margin portions of the recording material 20, so that the pair of regulating members 31 does not contact the unfixed toner image carried on the recording material 20 and thus it is possible to prevent disturbance of the unfixed toner image on the recording material 20 during the output. Further, as described above, the regulating members 31 do not contact the unfixed toner image carried on the recording material 20, so that the regulating members 31 themselves can stably perform separation and conveyance of the recording material 20 after the transfer while being kept in a state in which the regulating members 31 are not contaminated with the unfixed toner image.

Further, the pair of regulating members 31 has inclined side surface portions 31*a*' between which a distance is gradually narrowed from the regulating portion 31*b* side connected to the moving mechanism 32 toward the intermediary transfer belt 9 side. Further, the pair of regulating members 31 includes a pair of rotatable members 31*a* rotatable by the conveyance of the recording material 20 when the recording material 20 conveyed from the secondary transfer portion T2 contacts the side surface portions 31*a*'. The width control means 103 controls the pair of regulating members 31 so that when the regulating members 31 are moved to a position correspondingly to width information obtained by the recording material size detecting means 102, the distance between the end portions on the intermediary transfer belt 9 side is smaller than the width of the width information. As a result, even if the recording material 20 in the conveyance state is attracted toward the intermediary transfer belt 9 by the electrostatic force, the recording material 20 is regulated in movement thereof by the time when it reaches the position of the intermediary transfer belt 9-side end portions of the side surface portions 31*a*' of the regulating portions 31*a*. Therefore, it is possible to prevent the recording material 20 from being attracted toward the intermediary transfer belt 9 to contact and be adsorbed by the intermediary transfer belt 9.

(Embodiment 2)

Figure 7:
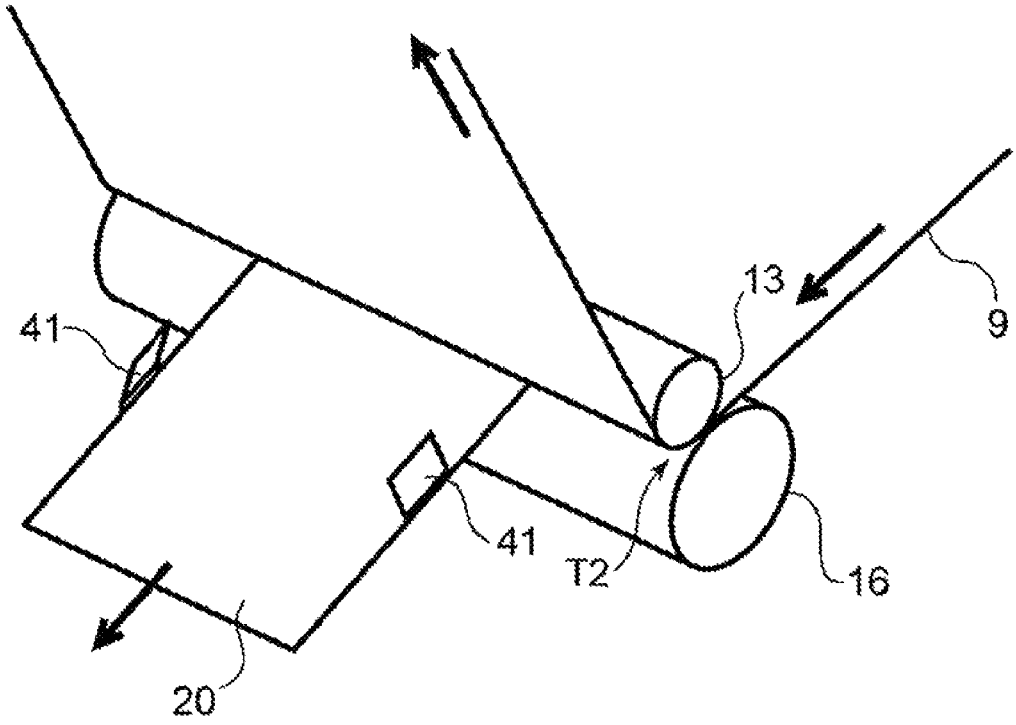
FIG. 7 is an enlarged schematic perspective view showing a regulating member, a secondary transfer portion and the neighborhood thereof in Embodiment 2.

A function in Embodiment 2, for improving a separation property of the recording material, employing the regulating member (regulating means) 41 as a feature of the present invention will be described with reference to FIG. 7 and FIG. 8. Incidentally, FIG. 7 is an enlarged schematic perspective view showing the regulating member 41, the secondary transfer portion T2 and the neighborhood thereof in Embodiment 2. Further, FIGS. 8(*a*) and 8(*b*) are schematic views showing the regulating member 41 and the moving mechanism 32, wherein FIG. 8(*a*) is a schematic view for illustrating the regulating member 41 and FIG. 8(*b*) is a plan view showing the moving mechanism 32 for moving the regulating member 41. Further, constitutions other than that of the regulating member 41 are, e.g., the same as those other than the regulating member 31 of the image forming apparatus shown in FIG. 1, thus being omitted from explanation by making reference thereto. In this embodiment, a regulating means is constituted by the regulating member 41 and the moving mechanism 32.

The pair of regulating members 41 is, as shown in FIG. 7, disposed downstream of the secondary transfer portion T2 with respect to the conveyance direction of the recording material 20 (e.g., at a distance of 10-20 mm from the secondary transfer portion T2), and is constituted so as to contactable to respective lateral sides of the recording material 20 with respect to the width direction perpendicular to the conveyance direction.

Figure 8:
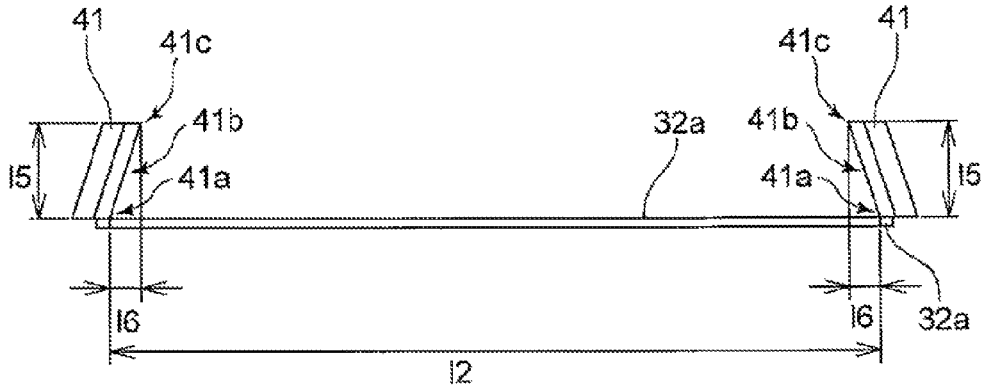
FIG. 8(*a*) is a schematic view for illustrating the regulating member, and FIG. 8(*b*) is a schematic plan view showing a moving mechanism for moving the regulating member.
Figure 8:
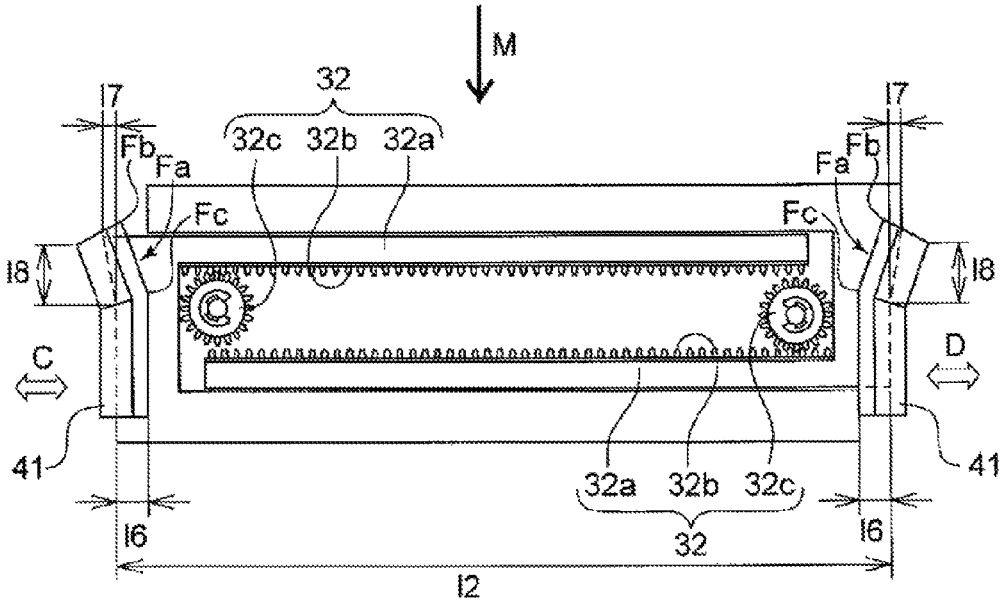

The pair of regulating members 41 is a plate-like member and is, as shown in FIG. 8(*a*), in the shape of surface inwardly slanted shape as seen from the downstream side with respect to the conveyance direction of the recording material 20 and has inclined surfaces between which a distance is gradually decreased from the base portions 41*a* connected to the moving mechanism 32 toward end portions 41*c* on the intermediary transfer belt 9 side. Further, the pair of regulating members 41 is formed by being bent so that their near-side portions are opened somewhat leftwardly and rightwardly when viewed from the frontside in FIG. 8(*a*). Specifically, the regulating members 41 has entrance portions Fa for permitting easy introduction of the recording material conveyed from the secondary transfer portion T2. The entrance portions Fa are constituted so that a distance between the entrance portions Fa is gradually narrowed from wide width portions Fb toward narrow width portions Fc with respect to the conveyance direction. As a result, the recording material 20 conveyed in the direction (conveyance direction) indicated by an arrow M shown in FIG. 8(*b*)) can be smoothly guided between the pair of regulating members 41.

Further, each of the regulating members 41 is moved by the moving mechanism 32 constituted by a moving member 32*a*, a toothed rack portion 32*b*, and a pinion 32*c*, similarly as in the case of the regulating members 31, so that it reciprocates in a left-right direction (the direction indicated by a double-pointed arrow C or D) when viewed from the front side in FIG. 8(*b*). As a result, the distance between the pair of regulating members 41 disposed on the line perpendicular to the conveyance direction of the recording material 20, i.e., a width l2 is variable.

In FIG. 2, as shown in FIGS. 8(*a*) and 8(*b*), a height l2 of each regulating member 41 is 10 mm and a width l6 in which each regulating member 41 is inclined to cover (overlap) the moving member 32*a* is 2 mm. A width l7 extended by the bent portion of each regulating member 41 is 2 mm and a length l8 of the bent portion of each regulating member 41 in FIG. 8(*b*) is 5 mm.

When the image formation is started in the image forming apparatus including the pair of regulating members 41 as described in this embodiment (Embodiment 2), the recording material size detecting means 102 (FIG. 1) obtains the width (width information) of an objective recording material 20. The pair of regulating members 41 is moved to a position corresponding to the detected width of the recording material 20 (a position in which the distance between the base portions 41*a* is the width l2) by rotational control of the pinions 32*c* by the width control means 103.

The pair of regulating members 41 which has been subjected to the movement control is located so that the end portions 41*c*, on the intermediary transfer belt 9 side, on the inclined surfaces 41*b* separate the respective lateral sides of the recording material 20 in the conveyance state and the intermediary transfer belt 9. As a result, even when the recording material 20 in the conveyance state is attracted toward the intermediary transfer belt 9 by the electrostatic force, movement of the recording material 20 is regulated by the time when the recording material 20 reaches the end portions 41*c*. Therefore, it is possible to prevent contact and adsorption between the recording material 20 and the intermediary transfer belt 9.

In this embodiment, e.g., with respect to the recording material 20 having a width of 143 mm and a conveyance direction length of 200 mm, and the width l2 of the pair of regulating members 41 was 140-142 mm less than the recording material width by 1-3 mm. As a result, the pair of regulating members 41 is subjected to movement control so as to move to a position in which the distance between the intermediary transfer belt 9-side end portions 41*c* on the inclined surfaces 41*b* is narrower than the width of the recording material 20 and in which the distance between the wide width portions Fb is larger than the width of the recording material 20 and the distance between the narrow width portions Fc is smaller than the width of the recording material 20. When the pair of regulating members 41 is moved to the position and then the recording material 20 is conveyed between the pair of regulating members 41 while being subjected to the transfer at the secondary transfer portion T2, the recording material 20 is bent and deformed in the shape of an arc with respect to the intermediary transfer belt 9 to improve its stiffness (rigidity) (e.g., FIG. 5). As a result, the recording material 20 can be further reduced in amount of flexure deformation to ward the intermediary transfer belt 9 by the electrostatic force, so that it is possible to prevent the recording material 20 from contact and being adsorbed by the intermediary transfer belt 9 and to prevent the occurrence of separation defect.

Thus, the pair of regulating members 41 having been subjected to the movement control is contactable to only the respective lateral sides of the recording material 20 with respect to the width direction perpendicular to the conveyance direction of the recording material 20. Such respective lateral sides 20*a* of the recording material 20 are margin portions of the recording material 20, so that the pair of regulating members 41 does not contact the unfixed toner image carried on the recording material 20 and thus it is possible to prevent disturbance of the unfixed toner image on the recording material 20 during the output. Further, as described above, the regulating members 41 do not contact the unfixed toner image carried on the recording material 20, so that the regulating members 41 themselves can stably perform separation and conveyance of the recording material 20 after the transfer while being kept in a state in which the regulating members 41 are not contaminated with the unfixed toner image.

Thus, in Embodiment 2, the pair of regulating members 41 for regulating the movement of the recording material toward the intermediary transfer belt 9 is subjected to movement control depending on the width information of the recording material by the width control means 103. As a result, it is possible to prevent contact and adsorption between the recording material and the intermediary transfer belt 9 without damaging the recording material after the transfer.

Further, the pair of regulating members 41 has inclined surfaces 41*b* between which the distance is gradually narrowed from the base portion 41*a* connected to the moving mechanism 32 toward the intermediary transfer belt 9-side end portions 41*c*. The width control means 103 controls the pair of regulating members 41 so that when the pair of regulating members 41 is moved to a position correspondingly to width information obtained by the recording material size detecting means 102, the distance between the end portions 41*c* of the pair of regulating member 41 is smaller than the width of the width information. As a result, even if the recording material 20 in the conveyance state is attracted toward the intermediary transfer belt 9 by the electrostatic force, the recording material 20 is regulated in movement thereof by the time when it reaches the position of the intermediary transfer belt 9-side end portions 41*c*. Therefore, it is possible to prevent the recording material 20 from being attracted toward the intermediary transfer belt 9 to contact and be adsorbed by the intermediary transfer belt 9.

(Embodiment 3)

Figure 9:
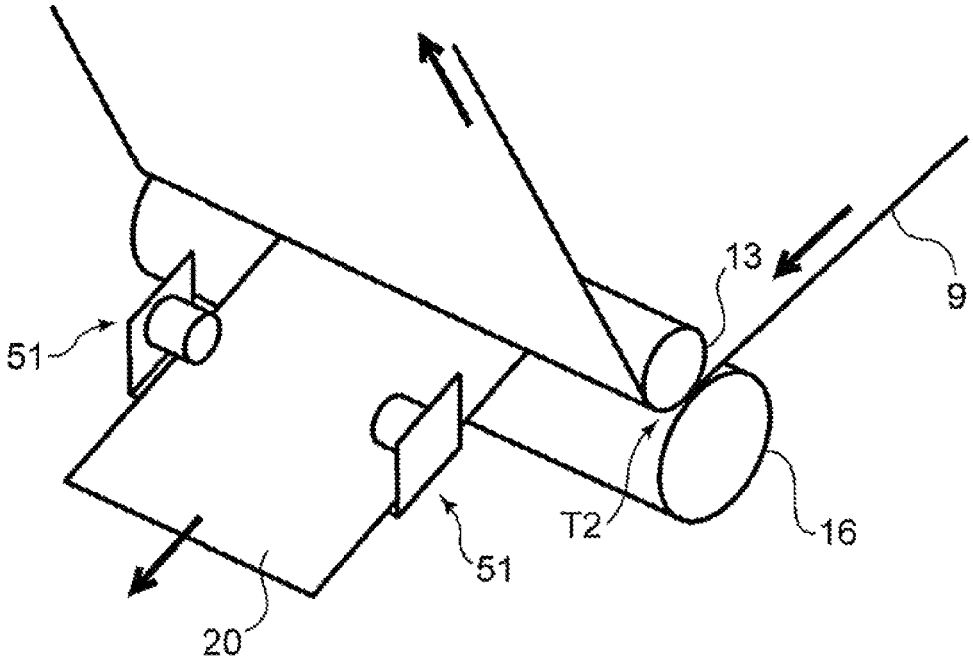
FIG. 9 is an enlarged schematic perspective view showing a regulating member, a secondary transfer portion and the neighborhood thereof in Embodiment 3.

A function in Embodiment 3, for improving a separation property of the recording material, employing a regulating device 51 as a feature of the present invention will be described with reference to FIG. 9 and FIG. 10. Incidentally, FIG. 9 is an enlarged schematic perspective view showing the regulating device 51, the secondary transfer portion T2 and the neighborhood thereof in Embodiment 3. Further, FIGS. 10(*a*), 10(*b*) and 10(*c*) are schematic views showing the regulating device 51 and the moving mechanism 32, wherein FIG. 10(*a*) is a schematic view for illustrating the regulating device 51, FIG. 10(*b*) is a plan view showing the moving mechanism 32 for moving regulating device 51, and FIG. 10(*c*) is a schematic view for illustrating an operation example of the regulating device 51. Further, constitutions other than that of the regulating device 51 are, e.g., the same as those other than the regulating member 31 of the image forming apparatus shown in FIG. 1, thus being omitted from explanation by making reference thereto. In this embodiment, a regulating means is constituted by the regulating device 51 and the moving mechanism 32.

The pair of regulating devices 51 is, as shown in FIG. 9, disposed downstream of the secondary transfer portion T2 with respect to the conveyance direction of the recording material 20 (e.g., at a distance of 10-20 mm from the secondary transfer portion T2), and is constituted so as to contactable to respective lateral sides of the recording material 20 with respect to the width direction perpendicular to the conveyance direction.

Figure 10:
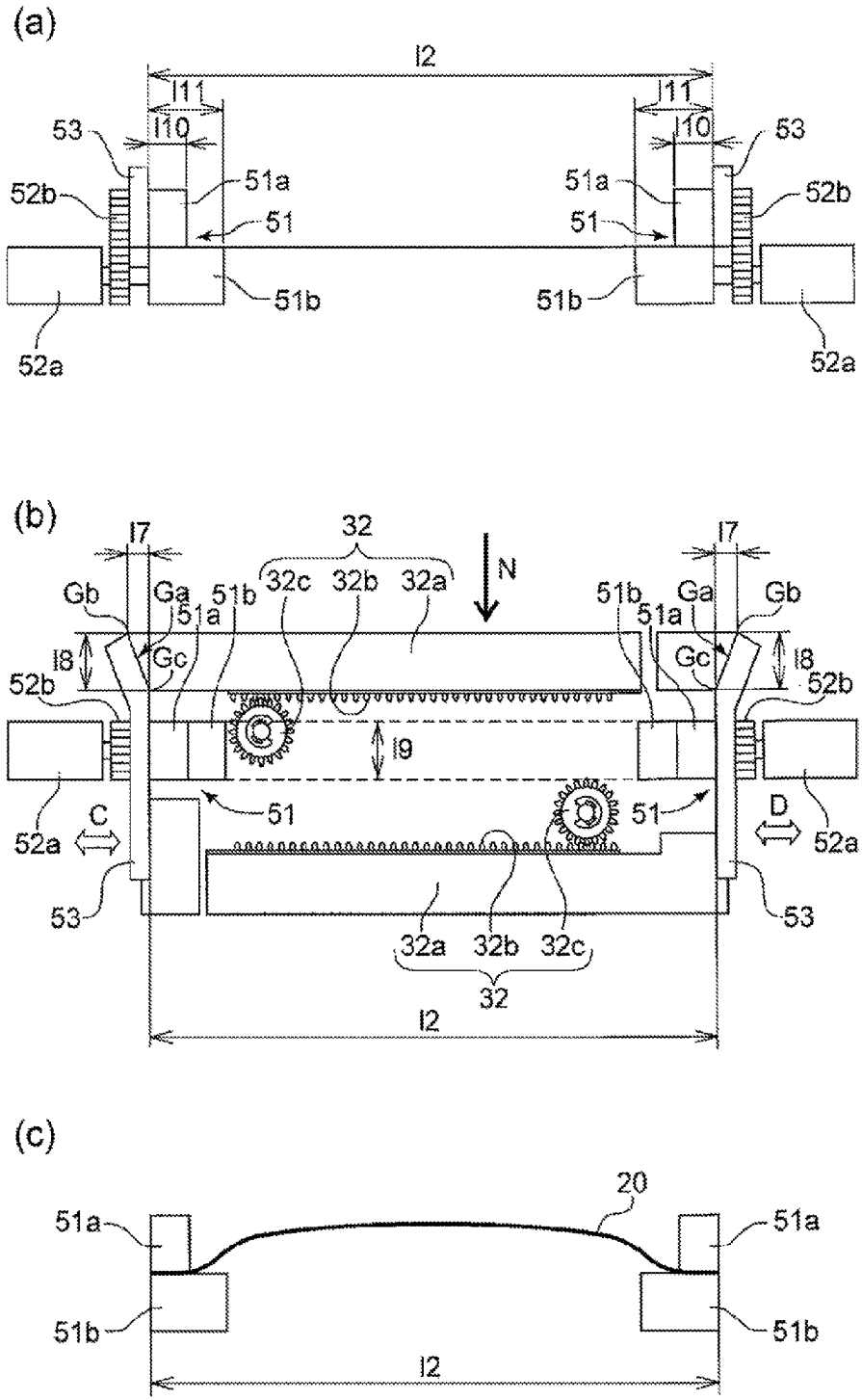
FIG. 10(*a*) is a schematic view for illustrating the regulating member, FIG. 10(*b*) is a schematic plan view showing a moving mechanism for moving the regulating member, and FIG. 10(*c*) is a schematic view for illustrating an operation example of a regulating device.
Figure 11:
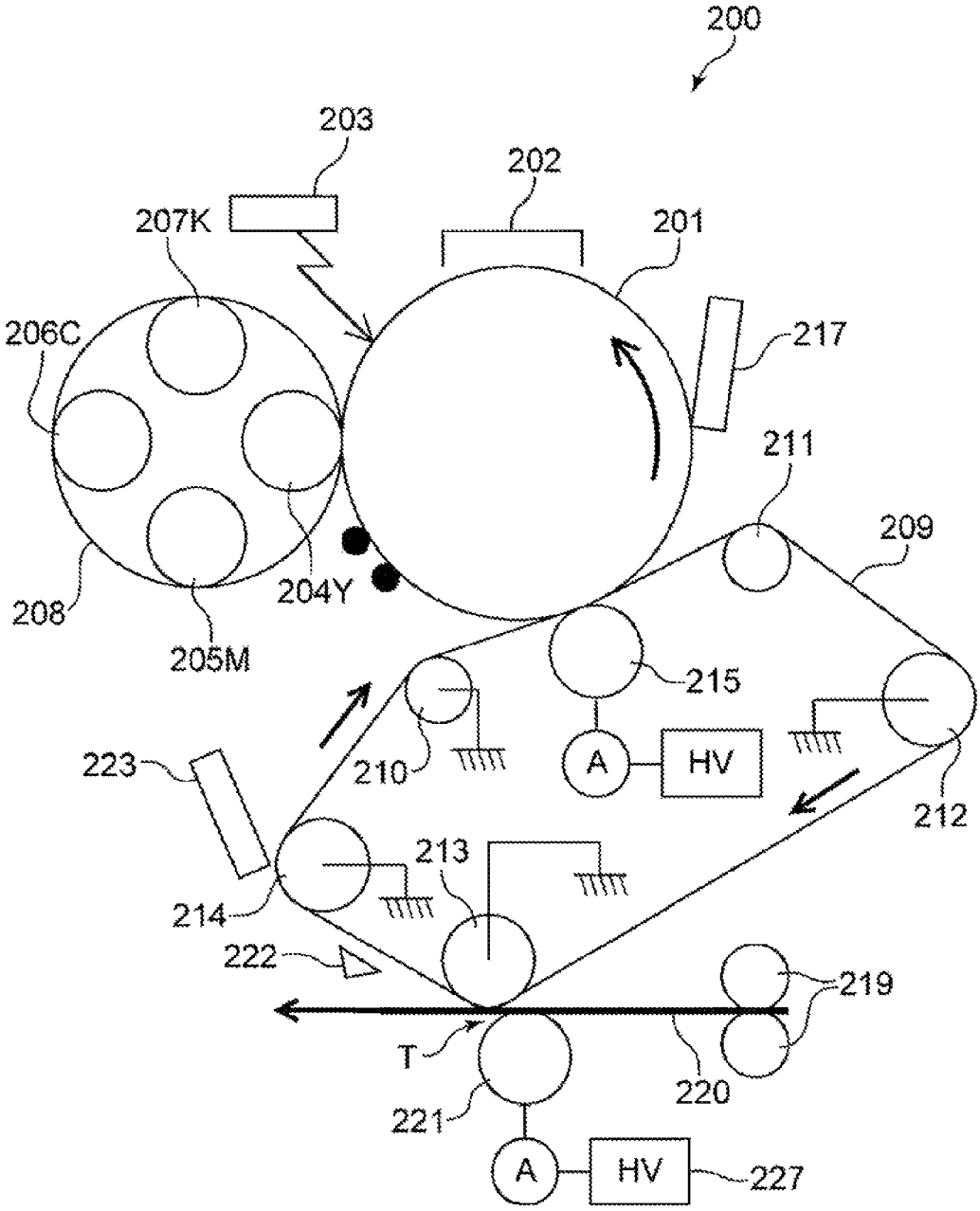
Fig. 11 PRIOR ART
FIG. 11 is a schematic view for illustrating a constitution of a conventional image forming apparatus.
Figure 12:
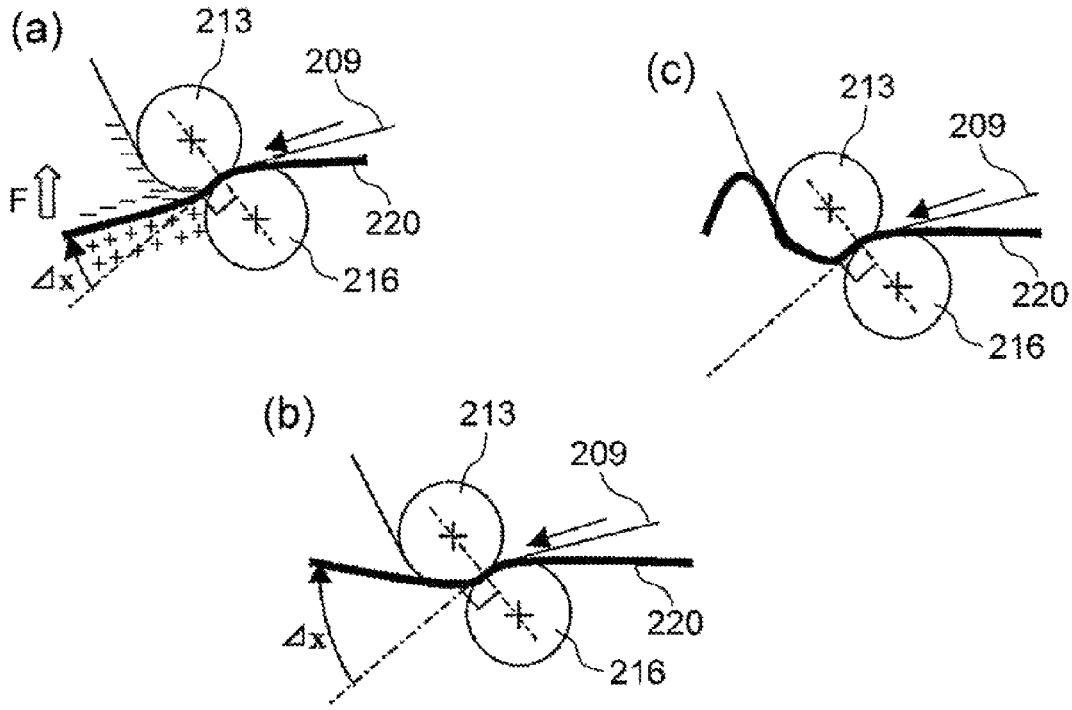
Fig. 12 PRIOR ART
FIGS. 12(*a*) to 12(*c*) are schematic views for illustrating an operation of a recording material conveyed from a secondary transfer portion in the conventional image forming apparatus.
Figure 13:
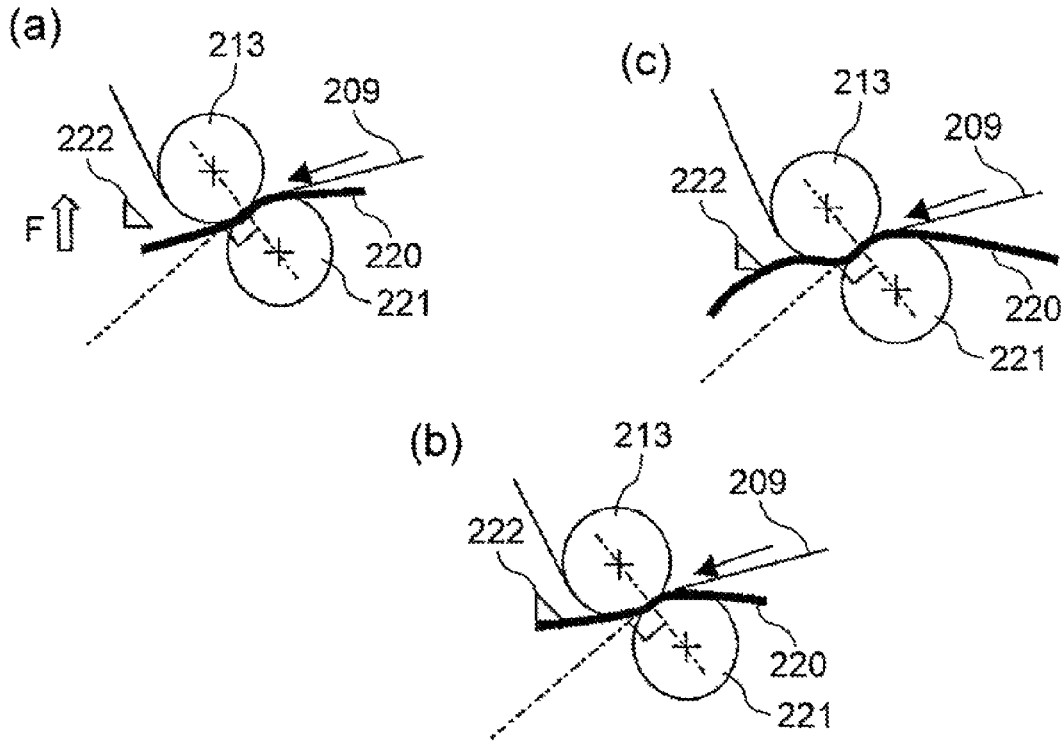
Fig. 13 PRIOR ART
FIGS. 13(*a*) to 13(*c*) are schematic views for illustrating an operation of a recording material conveyed from a secondary transfer portion in the conventional image forming apparatus provided with a separation claw.
Figure 14:
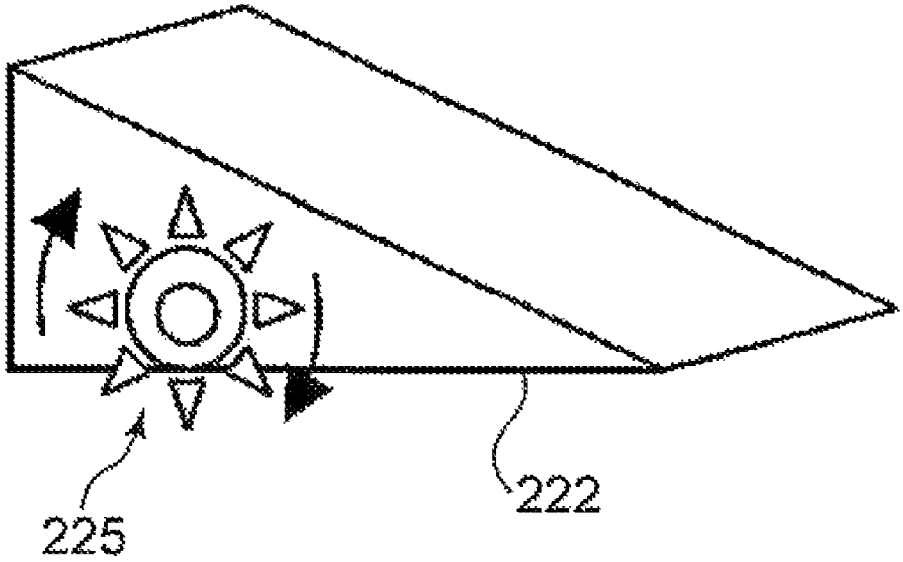
Fig. 14 PRIOR ART
FIG. 14 is a schematic view for illustrating a conventional separation claw provided with a wheel.

Each of the pair of regulating devices 51 includes, as shown in FIG. 10(*a*), rollers (a pair of conveyance rollers) 51*a* and 51*b*. Further, each regulating device 51 includes a motor 52*a* for supplying a rotational force to the rollers 51*a* and 51*b* and a gear mechanism for transmitting the rotational force from the motor 52*a* to the rollers 51*a* and 51*b*. Each regulating device 51 further includes a regulating member 53 disposed in a state in which the regulating member 53 is contactable to the rollers 51*a* and 51*b*.

The rollers 51*a* and 51*b* have the same diameter and are formed so that a length l10 of the roller 51*a* is ½ of a length l11 of the roller 51*b* with respect to the rotational axis direction. The rollers 51*a* and 51*b* are disposed so that their outer peripheral surfaces contact each other and are rotated at the same speed by receiving the rotational force from the motor 52*a* through the gear mechanism 52*b*.

Each regulating member 53 is a plate-like member and is disposed at a position in which it contacts one side surface of each of the rollers 51*a* and 51*b*.

Further, the regulating devices 51 are formed by being bent so that their near-side portions are opened somewhat leftwardly and rightwardly when viewed from the frontside in FIG. 10(*a*). Specifically, the regulating members 53 has entrance portions Ga for permitting easy introduction of the recording material conveyed from the secondary transfer portion T2. The entrance portions Ga are constituted so that a distance between the entrance portions Ga is gradually narrowed from wide width portions Gb toward narrow width portions Gc with respect to the conveyance direction. As a result, the recording material 20 conveyed in the direction (conveyance direction) indicated by an arrow N shown in FIG. 10(*b*)) can be smoothly guided between the pair of regulating devices 51.

Further, each of the regulating devices 51 is moved by the moving mechanism 32 constituted by a moving member 32*a*, a toothed rack portion 32*b*, and a pinion 32*c*, similarly as in the case of the regulating members 31 and 41, so that it reciprocates in a left-right direction (the direction indicated by a double-pointed arrow C or D) when viewed from the front side in FIG. 10(*b*). As a result, the distance between the pair of regulating members 41 disposed on the line perpendicular to the conveyance direction of the recording material 20, i.e., a width l2 is variable.

In FIG. 2, as shown in FIGS. 10(*a*) and 10(*b*), a length l10 of the roller 51*a* with respect to the rotational axis direction is 2 mm and a length l11 of the roller 51*b* with respect to the rotational axis direction is 4 mm. A diameter of both of the rollers 51*a* and 51*b* is 8 mm. The roller 51*a* is formed of the same material as that of the regulating member 53 (as specifically described later), and the roller 51*b* is prepared by coating a core metal having a diameter of 6 mm with a 1 mm-thick elastic layer of EPDM having a hardness (ASKER-C; 1000 gf) of 40 degrees. The rollers 51*a* and 51*b* are disposed at positions in which a depth of impression of each roller is 0 to 0.5 mm and have the above-described common driving means. The rollers 51*a* and 51*b* are regulated by the control portion 101 at the same speed as that of the secondary transfer inner roller 13 and the secondary transfer outer roller 16 at their outer peripheral surfaces. Further, a width l7 extended by the bent portion of each regulating member 53 is 2 mm and a length l8 of the bent portion of each regulating member 53 in FIG. 10(*b*) is 5 mm.

When the image formation is started in the image forming apparatus including the pair of regulating members 53 as described in this embodiment (Embodiment 3), the recording material size detecting means 102 (FIG. 1) obtains the width (width information) of an objective recording material 20. The pair of regulating devices 51 is moved to a position corresponding to the detected width of the recording material 20 (a position in which the distance between the regulating members 53 is the width l2 as shown in FIG. 10(*b*)) by rotational control of the pinions 32*c* by the width control means 103.

When the regulating devices 51 are moved and the recording material 20 is conveyed while being transferred as the secondary transfer portion T2, the recording material 20 is guided between the pair of regulating devices 51 by the regulating members 53. The recording material 20 guided by the regulating member 53 is held and conveyed between the rollers 51*a* and 51*b* rotating at the same speed as that of the secondary transfer inner and outer rollers 13 and 16. The thus conveyed recording material 20 is separated from the intermediary transfer belt 9 on its respective lateral sides by the respective rollers 51*a* of the pair of regulating devices 51. As a result, even when the recording material 20 in the conveyance state is attracted toward the intermediary transfer belt 9 by the electrostatic force, displacement of locus of the recording material 20 is regulated by the rollers 51*a* of the regulating members 53. Therefore, it is possible to prevent contact and adsorption between the recording material 20 and the intermediary transfer belt 9.

In this embodiment, e.g., with respect to the recording material 20 having a width of 143 mm and a conveyance direction length of 200 mm, and the width l2 of the regulating devices 51 (i.e., the distance between the pair of regulating members 53) was 140-142 mm less than the recording material width by 1-3 mm. As a result, the pair of regulating devices 51 is subjected to movement control so as to move to a position in which the distance between the rollers 51*a* is narrower than the width of the recording material 20 and in which the distance between the wide width portions Gb is larger than the width of the recording material 20 and the distance between the narrow width portions Gc is smaller than the width of the recording material 20. When the pair of regulating devices 51 is moved to the position with the width l2 and then the recording material 20 is held and conveyed between the pair of regulating devices 51 from the secondary transfer portion T2, the recording material 20 is bent and deformed in the shape of an arc with respect to the intermediary transfer belt 9 to improve its stiffness (rigidity) (FIG. 10(*c*)). At this time, the elastic layer of the roller 51*b* is pressed when the recording material 20 is held between the rollers 51*a* and 51*b*, so that inclination such that the elastic layer of the roller 51*b* ascends from the held lateral side portion toward the inside is formed. Therefore, the recording material 20 is liable to rise along the inclination. By being placed in such a state, the recording material 20 can be further reduced in amount of flexure deformation to ward the intermediary transfer belt 9 by the electrostatic force, so that it is possible to prevent the recording material 20 from contact and being adsorbed by the intermediary transfer belt 9 and to prevent the occurrence of separation defect.

Thus, the pair of regulating devices 51 having been subjected to the movement control is contactable to only the respective lateral sides of the recording material 20 with respect to the width direction perpendicular to the conveyance direction of the recording material 20 by holding the respective lateral sides of the recording material 20. Such respective lateral sides 20*a* of the recording material 20 are margin portions of the recording material 20, so that the pair of regulating devices 51 does not contact the toner image carried on the recording material 20 and thus it is possible to prevent disturbance of the unfixed toner image on the recording material 20 during the output. Further, as described above, the regulating devices 51 do not contact the unfixed toner image carried on the recording material 20, so that the regulating devices 51 themselves can stably perform separation and conveyance of the recording material 20 after the transfer while being kept in a state in which the regulating devices 51 are not contaminated with the unfixed toner image.

Thus, in Embodiment 3, the pair of regulating devices 51 for regulating the movement of the recording material toward the intermediary transfer belt 9 is subjected to movement control depending on the width information of the recording material by the width control means 103. As a result, it is possible to prevent contact and adsorption between the recording material and the intermediary transfer belt 9 without damaging the recording material after the transfer.

Further, the pair of regulating devices 51 includes the rollers 51*a* and 51*b*. The width control means 103 subjects the rollers 51*a* and 51*b* to movement control so that the rollers are moved to a position in which the rollers can hold the respective lateral sides of the recording material 20 with respect to the direction perpendicular to the conveyance direction of the recording material 20 depending on the width information of the recording material 20 obtained by the recording material size detecting means 102. As a result, even when the recording material 20 is attracted toward the intermediary transfer belt 9 by the electrostatic force, the movement of the recording material 20 toward the recording material 20 is regulated by the rollers 51*a* of the regulating devices 51. Therefore, it is possible to prevent contact and adsorption between the recording material 20 and the intermediary transfer belt 9.

Incidentally, as a base material for the regulating members 31 in Embodiment 1, the regulating members 41 in Embodiment 2, and the regulating devices 51 in Embodiment 3, e.g., resin materials such as thermoplastic polyimide resin, wholly aromatic polyester resin, polyether-ketone based resin, polyetherimide resin, and polyamideimide resin are used. As a reinforcing member, a fibrous reinforcing material such as an inorganic fiber based reinforcing material can be added. As the inorganic fiber based reinforcing material, it is possible to use metal fibers such as carbon fiber, glass fiber, graphite fiber, and stainless fiber; and whiskers such as calcium silicate whisker, calcium carbonate whisker, and a calcium sulphate whisker. Other whiskers or fibers such as magnesium sulphate whisker, magnesium nitrate whisker, magnesia fiber, aluminum borate whisker, alumina fiber, titanium oxide whisker, zinc oxide whisker, silicon carbide whisker, silicon nitride whisker, potassium titanate whisker, Tyranno fiber, zirconia fiber, Xonolite fiber, and wollastonite whisker can also be employed. The above fibers and whiskers can be used singly or in mixture of a plurality of species.

The above-described fibrous reinforcing materials are added in a resin composition in an amount of 13-46 wt. %, preferably 15-30 wt. %, further preferably 15-25 wt. %. Further, to the above-described synthetic resins, it is possible to add one or more species of powdery fillers such as calcium carbonate, mica, silica, talc, calcium sulphate, kaoline, clay, glass beads, and glass powder. Further, as other addable various additives, it is possible to use one or more species of a parting material, a lubricant, a heat stabilizer, an antioxidant, a UV absorber, a crystal nucleating agent, a foaming agent, an anticorrosive, an ion trapping agent, a fine retardant additive, a fine retardant aid, colorants such as a dye or a pigment, and an antistatic agent.

Further, with respect to the regulating member 31 in the present invention, a fluorine-containing resin coating film is formed at least at a surface portion to which the recording material 20 is contactable but may also be formed at the entire surface of the regulating member 31. A coating liquid for forming the fluorine-containing resin coating film is obtained by adding modified fluorine-containing resin powder into a solution or dispersion of unmodified fluorine-containing resin material. As the unmodified fluorine-containing resin material, it is possible to use PTFE, PFA, ETFE, and FEP singly or in mixture. Of these resin materials, PFA, PTFE and FEP, which are excellent in melt-flowability during the coating film formation and are liable to be formed in a continuous film, may preferably be used singly or in mixture. The modified fluorine-containing resin material can be obtained by irradiating the unmodified fluorine-containing resin material with radiation. As the unmodified fluorine-containing resin material to be irradiated with the radiation, PTFE may preferably be used since PTFE is less liable to cause heat fusion or softening after cross-linking and is excellent in heat-resistivity. As the radiation, radiation capable of causing cross-linking reaction of the unmodified fluorine-containing resin material, e.g., ionizing radiation having an ionization effect may preferably be used. Specifically, it is possible to use γ-ray, electron ray, X-ray, neutron ray, high-energy ion beam, and the like.

In the above-described embodiments, the pair of regulating member 31 (or the pair of regulating member 41 or the pair of regulating devices 51) includes the entrance portions Ea (or Fa or Ga). The entrance portions Ea (or Fa or Ga) are constituted so that the distance therebetween is gradually decreased from the wide width portions Eb (or Fb or Gb) toward the narrow width portions Ec (or Fc or Gc). Further, the width control means 103 effects control so that when, e.g., the pair of regulating member 31 is moved to the position corresponding to the width information obtained by the recording material size detecting means 102, the distance between the wide width portions is more than the width of the width information and the distance between the narrow width portions is less than the width of the width information. As a result, it is possible to smoothly guide the recording material 20 conveyed from the secondary transfer portion T2 to the space between the pair of regulating members 31.

Incidentally, it is also possible to employ such a constitution that a function of enhancing the separation property by passing the recording material between the regulating means is selected depending on the type of the recording material. Specifically, e.g., when a high-rigidity recording material such as a thick recording material is passed between the regulating means, it is possible to employ such a constitution that the width of (i.e., the distance between) the regulating means is increased to allow passing of the recording material without subjecting the recording material to regulation by the regulating means.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 158698/2008 filed Jun. 18, 2008, which is hereby incorporated by reference.

What is claimed is:

1. An image forming apparatus comprising:

an image bearing member;

a toner image forming portion for forming a toner image on said image bearing member;

a rotatable transfer member, pressing a recording material toward said image bearing member, for forming a transfer portion for transferring the toner image from said image bearing member onto a recording material; and a pair of regulating portions, provided at a position downstream of the transfer portion with respect to a normal conveyance direction of the recording material, for suppressing movement of the recording material toward said image bearing member, wherein at least a part of each of said regulating portions is provided on a rectilinear line perpendicular to the conveyance direction;

wherein each regulating portion contacts a lateral side of the recording material, respectively, passing through the transfer portion, and the recording material is bent and deformed in a shape of an arc so that a stiffness of the recording material is enhanced, and each regulating portion includes an end portion at an image bearing member side and a base portion at a transfer member side, so that a width between the regulating portions is decreased from the base portion toward the end portion, and wherein a width between the base portions is narrower than a width of the recording material passing through the transfer portion, with respect to a width direction.

2. An image forming apparatus comprising:

an image bearing member;

a toner image forming portion for forming a toner image on said image bearing member;

a rotatable transfer member, pressing a recording material toward said image bearing member, for forming a transfer portion for transferring the toner image from said image bearing member onto the recording material;

a pair of regulating portions, provided at a position downstream of the transfer portion with respect to a normal conveyance direction of the recording material, for suppressing movement of the recording material toward said image bearing member, wherein at least a part of each of said regulating portions is provided on a rectilinear line perpendicular to the conveyance direction;

wherein each regulating portion contacts a lateral side of the recording material, respectively, passing through the transfer portion, and the recording material is bent and deformed in a shape of an arc so that a stiffness of the recording material is enhanced, and each regulating portion includes an end portion at an image bearing member side and a base portion at a transfer member side, so that a width between the regulating portions is decreased from the base portion toward the end portion;

an input portion into which width information of the recording material with respect to the width direction perpendicular to the conveyance direction is to be inputted;

a driving device for driving said pair of regulating portions so as to change the width between the pair of regulating portions with respect to the width direction; and a controller for controlling drive of the driving device so that the width between the pair of regulating portions is increased according to the increase of the width information of the recording material.

3. The image forming apparatus according to claim 2, wherein the pair of regulating portions is a pair of rotatable members having inclined side surface portions between which a distance is decreased from their base portions connected to the driving device toward portions closer to said image bearing member, and wherein the pair of rotatable members is rotated by conveyance of the recording material when the recording material being conveyed from the transfer portion contacts the side surface portions.

4. The image forming apparatus according to claim 2, wherein the controller controls the drive of the driving device so that the pair of regulating portions are moved to a position in which the pair of regulating portions are capable of holding the recording material at both end portions of the recording material with respect to the width direction perpendicular to the conveyance direction of the recording material.

5. The image forming apparatus according to claim 2, wherein each regulating portion includes an entrance portion, for the recording material to be conveyed, configured to decrease its length from a broad portion toward a narrow portion with respect to the conveyance direction, and wherein the controller controls the drive of the driving device so that the broad portion has a length more than a width information of the recording material and the narrow portion has a length less than the width information of the recording material.

6. The image forming apparatus according to claim 2, wherein each regulating portion includes an entrance portion, for the recording material to be conveyed, configured to decrease its width from a broad portion toward a narrow portion with respect to the conveyance direction, and wherein the controller controls the driving device so that the broad portion has a length more than the width information of the recording material and the narrow portion has a length less than the width information of the recording material.

7. The image forming apparatus according to claim 6, wherein said input portion includes a detecting member for detecting a size of the recording material, wherein said driving device includes a rack portion and a pinion portion, and wherein said controller effects, depending on the width detected by said detecting member, rotation control of the pinion portion to move the rack portion together with said pair of regulating portions in the width direction of the recording material.

* * * * *